US008134060B2

(12) United States Patent
Taniguchi

(10) Patent No.: US 8,134,060 B2
(45) Date of Patent: Mar. 13, 2012

(54) ELECTRONIC KEYBOARD INSTRUMENT

(75) Inventor: Hirokazu Taniguchi, Tachikawa (JP)

(73) Assignee: Casio Computer Co., Ltd, Tokyo (JP)

( * ) Notice: Subject to any disclaimer, the term of this patent is extended or adjusted under 35 U.S.C. 154(b) by 0 days.

(21) Appl. No.: 12/822,538

(22) Filed: Jun. 24, 2010

(65) Prior Publication Data

US 2010/0326259 A1 Dec. 30, 2010

(30) Foreign Application Priority Data

Jun. 30, 2009 (JP) ..... 2009-154764
Jun. 30, 2009 (JP) ..... 2009-154768

(51) Int. Cl.
*G10C 3/12* (2006.01)

(52) U.S. Cl. ..... 84/423 R

(58) Field of Classification Search ..... 84/423 R, 84/453, 432–437
See application file for complete search history.

(56) References Cited

U.S. PATENT DOCUMENTS 4,679,477 A 7/1987 Monte
7,750,222 B2 * 7/2010 Osuga ..... 84/423 R

FOREIGN PATENT DOCUMENTS

JP 62-36695 2/1987
JP 62-110997 7/1987
JP 05073029 3/1993
JP 2000-099030 4/2000
JP 2005-222073 8/2005

OTHER PUBLICATIONS

Japanese Office Action for Japanese Application No. 2009-154764 mailed on Sep. 8, 2011.

* cited by examiner

*Primary Examiner* — Kimberly Lockett
(74) *Attorney, Agent, or Firm* — Turocy & Watson, LLP

(57) ABSTRACT

In an electronic keyboard instrument, a first switch board 11 and a second switch board 12 are independently provided in a keyboard chassis 1 separated from each other. The first switch board 11 has a first switch that is turned ON by a key 2 arranged on the keyboard chassis 1 in a manner to be rotatable in a vertical direction upon the depression of the key 2. The second switch board 12 has a second switch 5 that is turned ON by a hammer member 3 that rotates to be displaced in response to the depression of the key 2 and applies action load to the key 2. Accordingly, even if the second switch board 12 receives an impact from the hammer member 3 when the hammer member 3 turns ON the second switch 5, the impact is not easily transmitted to the first switch 4.

10 Claims, 11 Drawing Sheets

ELECTRONIC KEYBOARD INSTRUMENT

CROSS-REFERENCE TO RELATED APPLICATIONS

This application is based upon and claims the benefit of priority from the prior Japanese Patent Applications No. 2009-154764, filed Jun. 30, 2009 and No. 2009-154768, filed Jun. 30, 2009, the entire contents of which are incorporated herein by reference.

BACKGROUND OF THE INVENTION

1. Field of the Invention

The present invention relates to an electronic keyboard instrument, such as an electronic piano.

2. Description of the Related Art

As described in Japanese Patent Application Laid-Open (Kokai) Publication No. H05-73029, an electronic keyboard instrument is conventionally known that is configured to achieve a key-press feel similar to that of an acoustic piano. In this electronic keyboard instrument, a heavy hammer member, which is provided under a key in a manner to be rotatable in a vertical direction, rotates against its own weight in response to a key depression operation, thereby applying a predetermined action load to the key.

This type of electronic keyboard instrument is structured such that a hammer switch that is turned ON by a hammer member is provided on the lower surface of a switch board, and a key switch that is turned ON and OFF by a key is provided on the upper surface of the switch board. As a result of this structure, in consecutive key-striking such as a trill in which the same key is repeatedly struck, a musical sound can be generated even when the same key is depressed before the key and the hammer member return from a final position to an initial position after rotating.

In an electronic keyboard instrument such as this, after a key is depressed and the key switch is turned ON thereby, the hammer member rotates to be displaced towards the final position, whereby the hammer switch is turned ON, and an instruction to start generating a musical sound is given. In an ordinary performance, when the hammer member and the key rotate to return from the final position to the initial position, the key switch is turned OFF after the hammer switch is turned OFF, and as a result of the key switch being turned OFF, the generation of the musical sound is stopped and the musical sound is silenced.

Conversely, in consecutive key-striking in which the same key is repeatedly struck, the key switch is not turned OFF when the hammer member rotates to return from the final position to the initial position after a key is depressed and the generation of a musical sound starts, and remains turned ON after the hammer switch is turned OFF. Then, when the same key is depressed, the hammer switch is turned ON again without the generation of the musical sound being stopped. Accordingly, in this electronic keyboard instrument, musical sound can be consecutively generated, even when consecutive key-striking in which the same key is repeatedly struck, such as a trill, is performed.

However, since a conventional electronic keyboard instrument such as this is configured such that a hammer switch that is turned ON by a hammer member is provided on the lower surface of a switch board, and a key switch that is turned ON and OFF by a key is provided on the upper surface of the switch board, a problem so-called chattering arises therein. In chattering, after a key is depressed and the key switch is turned ON thereby, when the hammer member rotates to be displaced towards the final position and the hammer switch is turned ON, the impact of the hammer member on the hammer switch is transmitted to the key switch of the switch board, causing the key switch to turn OFF for an instant.

SUMMARY OF THE INVENTION

The present invention has been conceived to solve the above-described problem. An object of the present invention is to provide an electronic keyboard instrument capable of stabilizing the operations of a first switch and a second switch, without the first switch being affected by an impact caused by a hammer member turning ON the second switch.

In order to achieve the above-described object, in accordance with one aspect of the present invention, there is provided an electronic keyboard instrument in which a key is arranged on a keyboard chassis in a manner to be rotatable in a vertical direction, and a hammer member correspondingly arranged below the key rotates to be displaced in response to depression of the key and applies action load to the key, comprising: a first switch board having a first switch that is turned ON by the key upon the depression of the key; and a second switch board having a second switch that is turned ON by the hammer member that rotates to be displaced in response to the depression of the key; wherein the first switch board and the second switch board are independently provided in the keyboard chassis separated from each other.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 8 is a cross-sectional view showing a state where the key is further pressed from the state in FIG. 7 and the hammer member turns a second switch ON;

DETAILED DESCRIPTION OF THE PREFERRED EMBODIMENTS

The present invention will hereinafter be described in detail with reference to a first embodiment shown in FIG. 1 to FIG. 8 in which the present invention has been applied to an electronic keyboard instrument.

Figure 1:
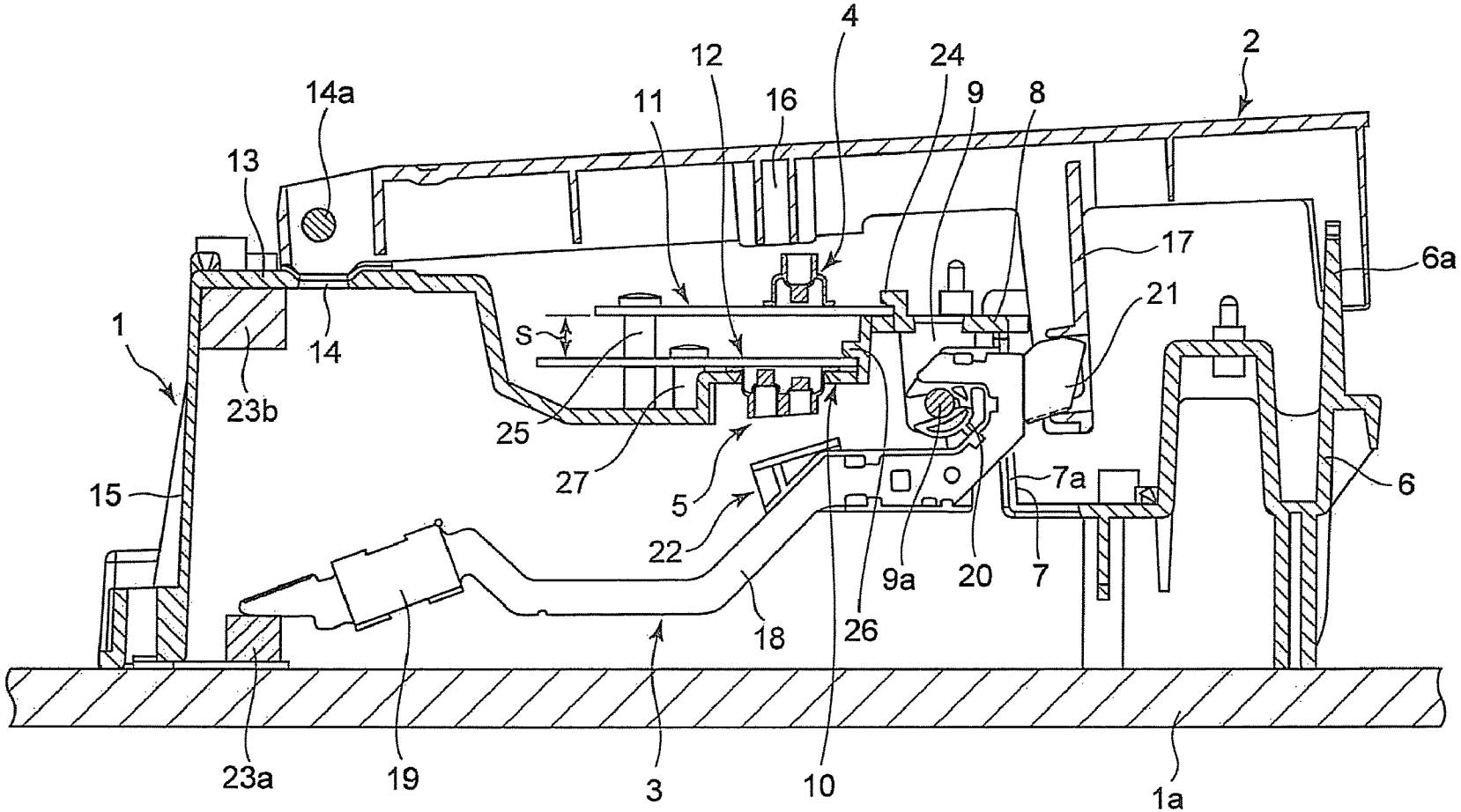
FIG. 1 is a cross-sectional view showing the main section of a first embodiment where the present invention has been applied to a electronic keyboard instrument.

As shown in FIG. 1, the electronic keyboard instrument includes a keyboard chassis 1 made of synthetic resin, a plurality of keys 2 (white keys and black keys, although only a single white key will be described for the first embodiment), a plurality of hammer members 3 (although only a single hammer member 3 will be described for the first embodiment), a first switch board 11, and a second switch board 12. The plurality of keys 2 are arranged on the keyboard chassis 1 in a manner to be rotatable in a vertical direction, and the plurality of hammer members 3 respectively apply action load to the plurality of keys 2. The first switch board 11 has a plurality of first switches 4 that are respectively turned ON by the plurality of keys 2, and the second switch board 12 has a plurality of second switches 5 that are respectively turned ON by the plurality of hammer members 3.

As shown in FIG. 1, the keyboard chassis 1 is arranged on a bottom board 1*a* of an instrument body (not shown), and a front leg section 6 is formed in the front end portion (right end portion in FIG. 1) of this keyboard chassis 1 in a manner to project upwards from the bottom portion. In addition, a key guiding section 6*a* for preventing horizontal play of the key 2 is provided in the upper portion of the front leg section 6, and as shown in FIG. 1, a rising section 7 is formed at rear (at left in FIG. 1) of the front leg section 6, at a height slightly lower than that of the key guiding section 6*a*.

Moreover, a hammer-insertion opening 7*a* is formed in the rising section 7. The front portion side of the hammer member 3, described hereafter, is inserted into this opening 7*a* and moves in the vertical direction. A hammer placing section 8 is formed in the upper portion of the rising section 7 in a manner to be substantially horizontal towards the rear portion side (left side in FIG. 1), and as shown in FIG. 1, a hammer supporting section 9 for supporting the hammer member 3 is provided in the lower portion of this hammer placing section 8 in a manner to project downwards. A supporting shaft 9*a* that rotatably supports the hammer member 3 is provided in this hammer supporting section 9.

As shown in FIG. 1, a board mounting section 10, which is formed on the rear portion side of the hammer placing section 8, includes a side wall section 10*a* hanging downward from the rear end portion of the hammer placing section 8 and amounting section 10*b* extending horizontally from the lower portion of the side wall section 10*a* towards the rear. This board mounting section 10 is configured such that the first switch board 11 provided with the plurality of first switches 4 and the second switch board 12 provided with the plurality of second switches 5, described hereafter, are mounted opposing each other from above and below.

As shown in FIG. 1, a key placing section 13 is formed in the rear portion of the keyboard chassis 1, namely the rear portion side of the board mounting section 10, at a height slightly higher than that of the hammer placing section 8, and a key supporting section 14 is formed on the upper surface of this key placing section 13. A supporting shaft 14*a* that rotatably supports the rear end portion of the key 2 in the vertical direction is provided in this key supporting section 14. As shown in FIG. 1, a rear leg section 15 that supports the rear end portion of the keyboard chassis 1 hangs downward from the rear end portion of the key placing section 13.

On the other hand, as shown in FIG. 1, the rear end portion (left end portion in FIG. 1) of the key 2 is supported in a manner to be rotatable in the vertical direction by the supporting shaft 14*a* of the key supporting section 14 provided on top of the key placing section 13 of the keyboard chassis 1. A switch pressing section 16, which is formed projecting downward in the middle portion of the key 2, presses the first switch 4 of the first switch board 11 arranged in the board mounting section 10 of the keyboard chassis 1, described hereafter.

As shown in FIG. 1, a hammer guiding section 17 that projects toward the bottom side of the key 2 is formed in an area in front (right in FIG. 1) of the switch pressing section 16 of the key 2, and configured such that a key contacting section 21 positioned in the front end portion of the hammer member 3, described hereafter, is slidably inserted thereinto, and the inserted key contacting section 21 is displaced in the vertical direction in response to the key 2 being depressed.

As shown in FIG. 1, this hammer member 3 includes a hammer body 18, an anchor section 19, a rotation supporting section 20 made of synthetic resin, the key contacting section 21, and a switch pressing section 22. The anchor section 19 is provided in the rear portion (left side portion in FIG. 1) of the hammer body 18. The rotation supporting section 20 is provided in the upper front portion (upper right portion in FIG. 1) of the hammer body 18 and serves as a rotational center for the hammer body 18. The key contacting section 21 is provided in the front end portion (right end portion in FIG. 1) of the hammer body 18. The switch pressing section 22 is provided in the upper portion of the middle portion of the hammer body 18 and is used to press the second switch 5 of the second switch board 12, described hereafter.

In addition, as shown in FIG. 1, the hammer member 3 is configured such that the key contacting section 21 of the hammer body 18 is inserted into the opening 7*a* in the rising section 7 from the lower side of the keyboard chassis 1 and projects towards the front side (right side in FIG. 1) of the hammer placing section 8. In this state, the rotation supporting section 20 of the hammer body 18 is rotatably attached to the supporting shaft 9*a* of the hammer supporting section 9 provided in the hammer placing section 8. As a result, the hammer body 18 rotates in the vertical direction around the supporting shaft 9*a* of the hammer supporting section 9.

Moreover, as shown in FIG. 1, the hammer member 3 is configured such that, when the rotation supporting section 20 of the hammer body 18 is rotatably attached to the supporting shaft 9*a* of the hammer supporting section 9, the key contacting section 21 provided in the front end portion of the hammer body 18 is slidably inserted into the hammer guiding section 17 of the key 2. In this state, the key contacting section 21 is displaced in the vertical direction with the hammer guiding section 17 in response to the key 2 being depressed. As a result, the hammer body 18 rotates in the vertical direction around the supporting shaft 9*a* of the hammer supporting section 9.

Accordingly, as shown in FIG. 1, the hammer member 3 is configured such that, in an initial state where the key 2 has not been depressed, the hammer body 18 rotates in the counterclockwise direction around the supporting shaft 9 of the hammer supporting section 9 by the weight of the anchor section 19, and the rear portion of the hammer body 18 comes into contact with a lower-limit stopper 23*a* such as a piece of felt provided in the lower rear end portion of the keyboard chassis 1. As a result, the position of the hammer member 3 is restricted to a predetermined lower-limit position.

Figure 7:
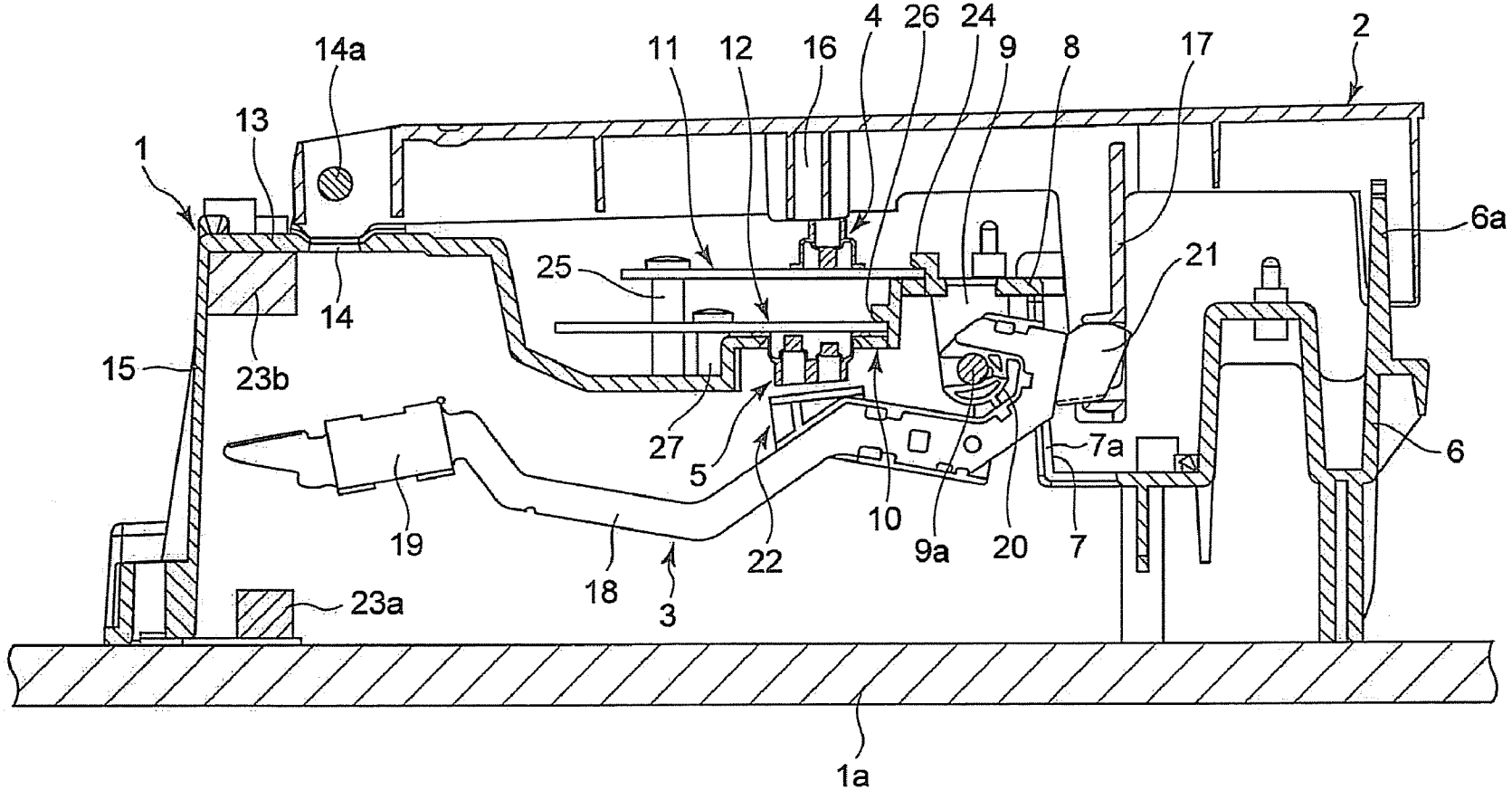
FIG. 7 is a cross-sectional view showing a state where only a first switch is turned ON when a key is pressed and a hammer member rotates in the electronic keyboard instrument in FIG. 1.
Figure 8:
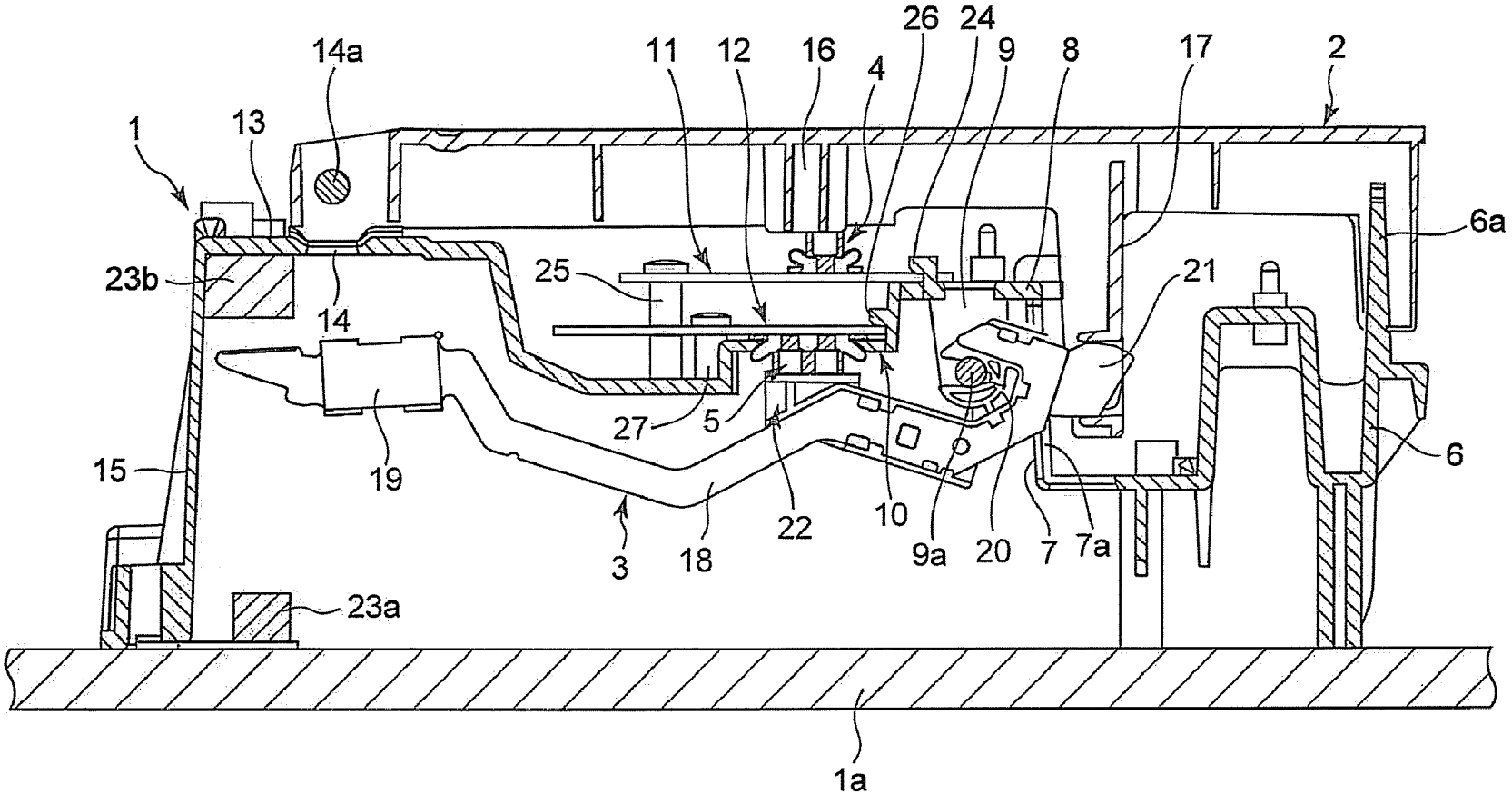

Furthermore, as shown in FIG. 7 and FIG. 8, the hammer member 3 is configured such that, when the key 2 is depressed from above, the key contacting section 21 of the hammer body 18 is pressed downward against the weight of the anchor section 19 by the hammer guiding section 17 of the key 2, and the hammer body 18 rotates in the clockwise direction around the supporting shaft 9*a* of the hammer supporting section 9 with this movement. As a result, action load is applied to the key 2. The rear portion of the hammer body 18 then comes into contact with an upper-limit stopper 23*b*, such as a piece of felt, provided on the lower surface of the key placing section 13 of the keyboard chassis 1.

As shown in FIG. 1 to FIG. 6, the first switch board 11 having the first switches 4 that are turned ON by the keys 2 and the second switch board 12 having the second switches 5 that are turned ON by the hammer members 3 are independently provided in the board mounting section 10 of the keyboard chassis 1, separated and opposing each other in the vertical direction.

Figure 3:
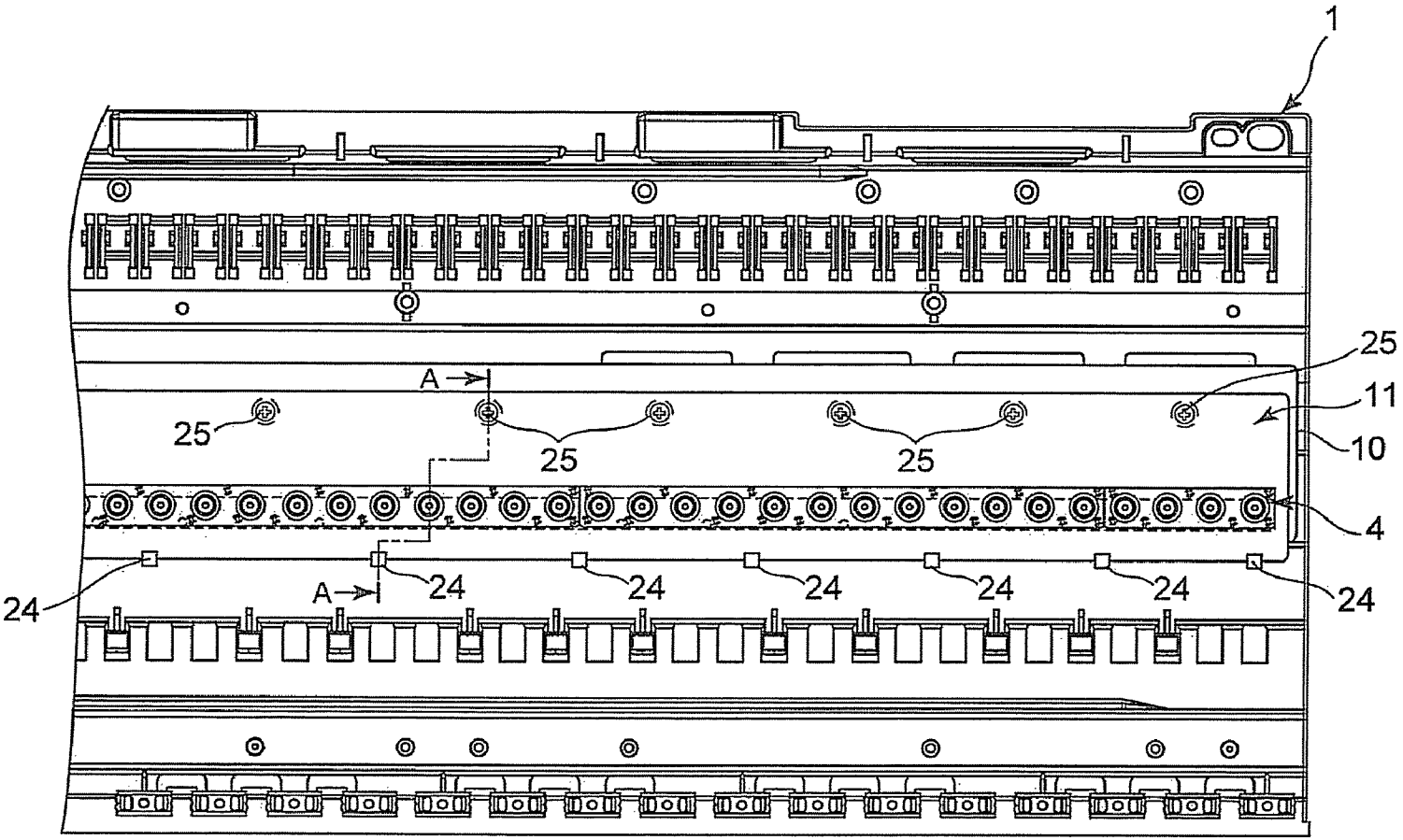
FIG. 3 is a planar view showing the main section, where only the first switch board has been mounted on the keyboard chassis of the electronic keyboard device in FIG. 2.
Figure 4:
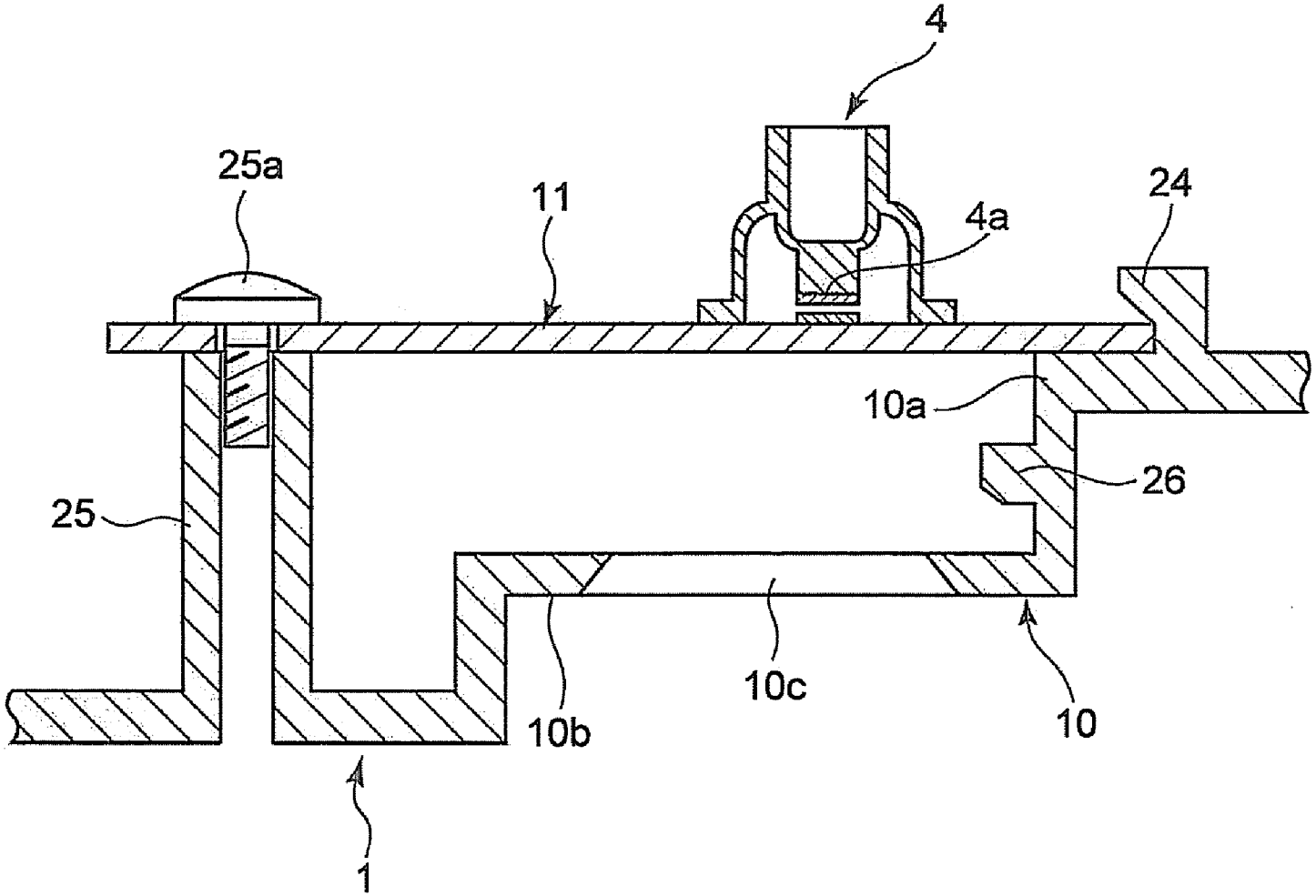
FIG. 4 is an enlarged cross-sectional view showing the main section taken along line A-A in FIG. 3.

That is, as shown in FIG. 3 and FIG. 4, the first switch board 11 is formed in an elongated strip shape along the direction in which the keys 2 are arrayed. One edge portion (right edge portion in FIG. 4) of the first switch board 11 is detachably locked by a plurality of first engaging hooks 24 formed in the upper portion of the side wall section 10*a* of the board mounting section 10 of the keyboard chassis 1. In this state, another edge portion side (left edge portion side in FIG. 4) of the first switch board 11 is attached by screws 25*a* to a plurality of first supporting bosses 25 formed in the board mounting section 10.

Figure 5:
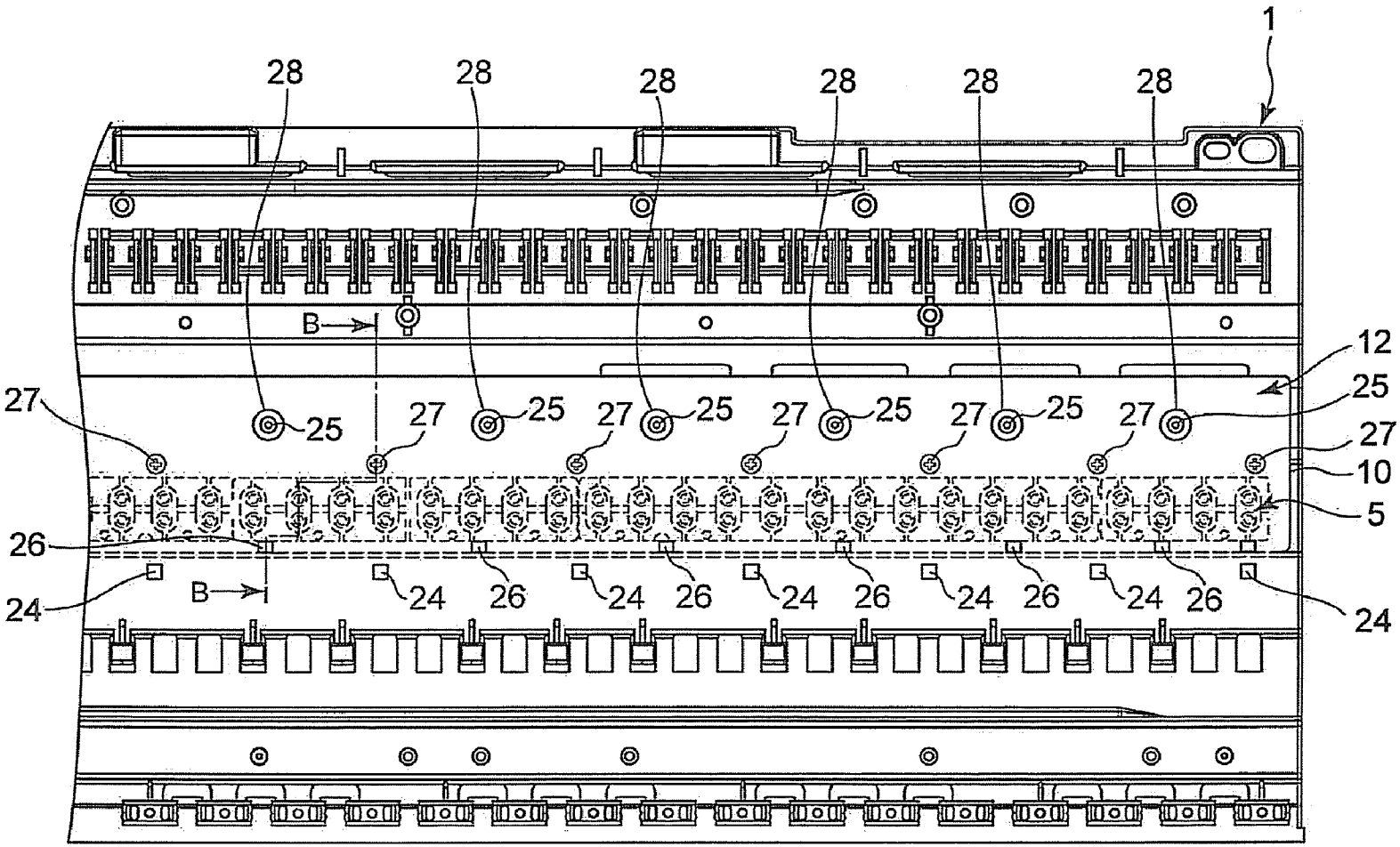
FIG. 5 is a planar view showing the main section, where only the second switch board has been mounted on the keyboard chassis of the electronic keyboard instrument in FIG. 2.
Figure 6:
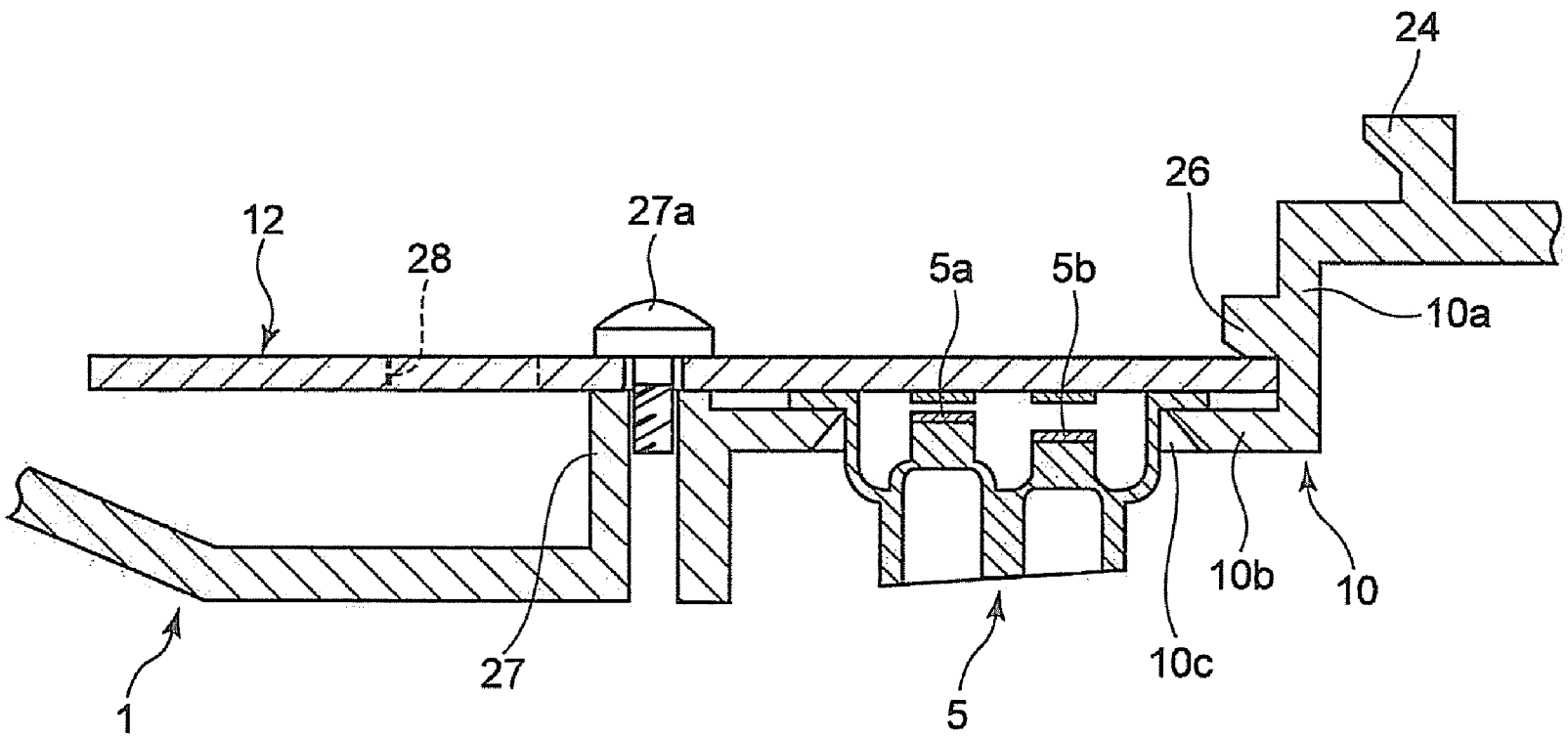
FIG. 6 is an enlarged cross-sectional view showing the main section taken along line B-B in FIG. 5.

In a manner similar to that of the first switch board 11, the second switch board 12 is formed in an elongated strip shape along the direction in which the keys 2 are arrayed. As shown in FIG. 5 and FIG. 6, one edge portion (right edge portion in FIG. 6) of the second switch board 12 is detachably locked by a plurality of second engaging hooks 26 and disposed on the mounting section 10*b* of the board mounting section 10. These plurality of second engaging hooks 26 are formed in a position below the first engaging hooks 24 in the board mounting section 10 of the keyboard chassis 1, namely in the lower portion of the side wall section 10*a*. In this state, another edge portion side (left edge portion side in FIG. 6) of the second switch board 12 is attached by screws 27*a* to a plurality of second supporting bosses 27 formed in the board mounting section 10 at a height lower than that of the first supporting bosses 25. Accordingly, the second switch board 12 is attached at a distance below the first switch board 11.

As a result, as shown in FIG. 1, the first supporting bosses 25 of the first switch board 11 are formed higher than the second supporting bosses 27 of the second switch board 12. In addition, the first engaging hooks 24 of the first switch board 11 are formed in a position higher than that of the second engaging hooks 26 of the second switch board 12, that is, in the upper portion of the side wall section 10*a* of the board mounting section 10. Accordingly, the first switch board 11 is arranged above the second switch board 12 with a predetermined space S therebetween.

That is, as shown in FIG. 1, the space S between the first switch board 11 and the second switch board 12 is set to a distance at which the first switch board 11 and the second switch board 12 do not come into contact with each other when the second switch board 12 bends upwards as a result of the second switch 5 of the second switch board 12 being pressed upward by the switch pressing section 22 of the hammer member 3 while the first switch board 11 is bending downward as a result of the first switch 4 of the first switch board 11 being pressed by the switch pressing section 16 of the key 2.

As shown in FIG. 5, a plurality of insertion holes 28 into which the first supporting bosses 25 of the first switch board 11 are inserted are provided at predetermined intervals along the other edge portion (upper edge portion in FIG. 5) of the second switch board 12. These insertion holes 28 are formed sufficiently larger than the outer diameter of the first supporting boss 25 so that the first supporting boss 25 is inserted into the insertion hole 28 without coming into contact with the second switch board 12.

As shown in FIG. 3, the plurality of first engaging hooks 24 and the plurality of first supporting bosses 25 for attaching the first switch board 11 to the keyboard chassis 1 respectively face the intermediate sections of the other. In other words, each first engaging hook 24 is provided in a position facing an intermediate section between two first supporting bosses 25, and each first supporting boss 25 is provided in a position facing an intermediate section between two first engaging hooks 24. Accordingly, the plurality of first engaging hooks 24 and the plurality of first supporting bosses 25 are provided in the board mounting section 10 of the keyboard chassis 1 in a staggered pattern along the length direction of the first switch board 11, that is, the arrangement direction of the keys 2.

Similarly, as shown in FIG. 5, the plurality of second engaging hooks 26 and the plurality of second supporting bosses 27 for attaching the second switch board 12 to the keyboard chassis 1 respectively face the intermediate sections of the other. In other words, each second engaging hook 26 is provided in a position facing an intermediate section between two second supporting bosses 27, and each second supporting boss 27 is provided in a position facing an intermediate section between two second engaging hooks 26. Accordingly, the plurality of second engaging hooks 26 and the plurality of second supporting bosses 27 are provided in the board mounting section 10 of the keyboard chassis 1 in a staggered pattern along the length direction of the second switch board 12, that is, the arrangement direction of the keys 2.

Figure 2:
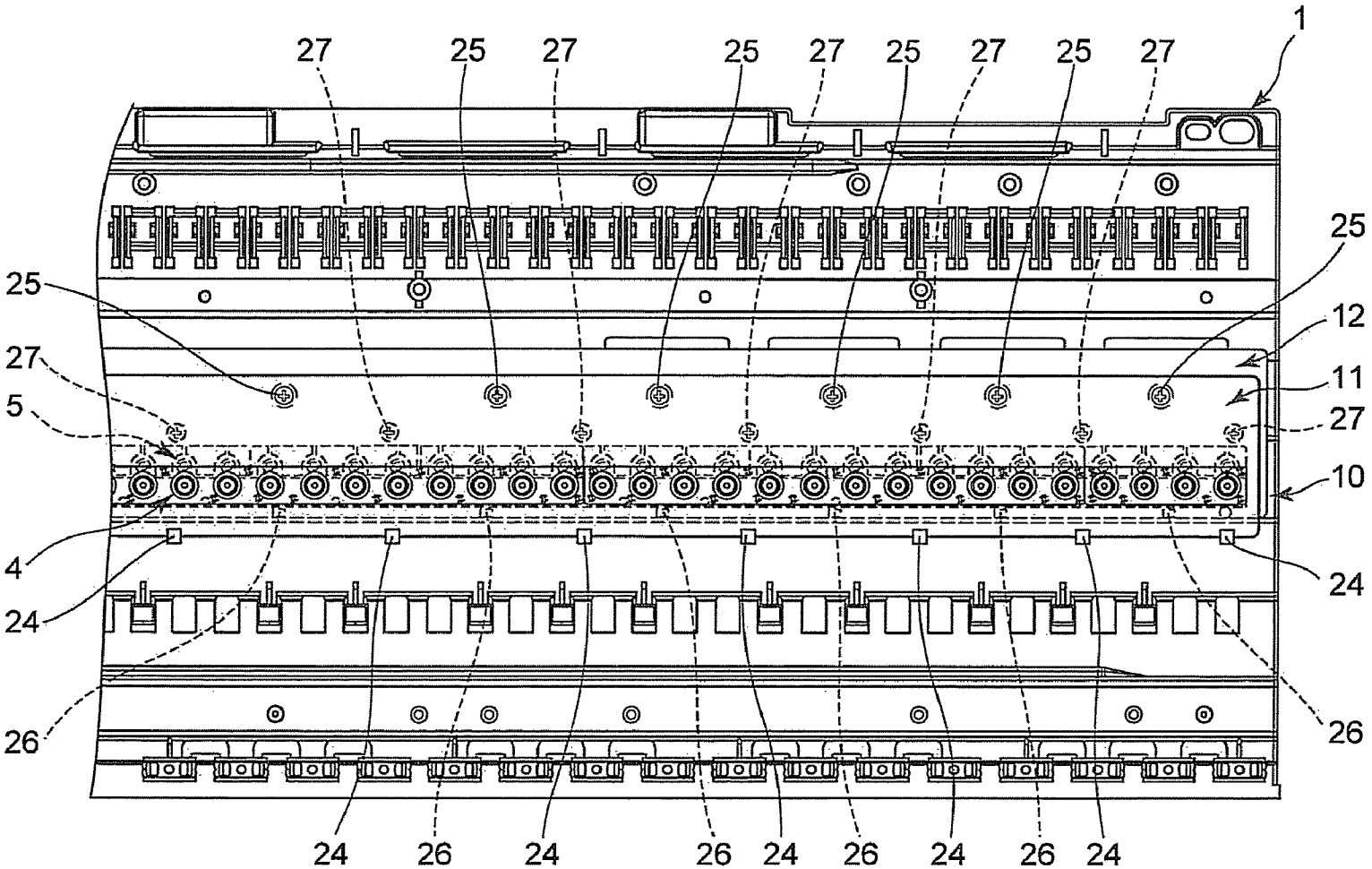
FIG. 2 is a planar view showing the main section, where a first switch board and a second switch board have been mounted on the keyboard chassis of the electronic keyboard device in FIG. 1.

As shown in FIG. 1, FIG. 2 and FIG. 5, the first engaging hooks 24 of the first switch board 11 are provided in a position shifted further toward the front side (right side in FIG. 5) of the keyboard chassis 1 than that of the second engaging hooks 26 of the second switch board 12. In addition, as shown in FIG. 2 and FIG. 5, each second engaging hook 26 is provided in a position facing an intermediate section between two first engaging hooks 24. Accordingly, the first engaging hooks 24 and the second engaging hooks 26 are provided in the board mounting section 10 of the keyboard chassis 1 in a staggered pattern along the arrangement direction of the keys 2.

Furthermore, as shown in FIG. 2, FIG. 3 and FIG. 5, the first supporting bosses 25 of the first switch board 11 are provided in a position shifted further toward the rear side (left side in FIG. 5) of the keyboard chassis 1 than that of the second supporting bosses 27 of the second switch board 12. In addition, as shown in FIG. 2 and FIG. 5, each second supporting boss 27 is provided in a position facing an intermediate section between two first supporting bosses 25. Accordingly, in a manner similar to that of the first engaging hooks 24 and the second engaging hooks 26, the first supporting bosses 25 and the second supporting bosses 27 are provided in the board mounting section 10 of the keyboard chassis 1 in a staggered pattern along the arrangement direction of the keys 2.

In the attachment of the first switch board 11 and the second switch board 12, configured as described above, to the keyboard chassis 1, the first switch board 11 is attached to the keyboard chassis 1 after the second switch board 12 is attached to the keyboard chassis 1. That is, in the attachment of the second switch board 12 thereto, the first supporting bosses 25 provided in the board mounting section 10 of the keyboard chassis 1 are inserted into the insertion holes 28 provided in the second switch board 12 without coming into contact with the second switch board 12.

In this state, the one end portion of the second switch board 12 is engaged with the second engaging hooks 26 of the board mounting section 10, and the other end portion side of the second switch board 12 is arranged on the second supporting bosses 27 to be fixed by the screws 27*a*. Then, the first switch board 11 is arranged above the second switch board 12 and attached. At this time, the one end portion of the first switch board 11 is engaged with the first engaging hooks 24 of the board mounting section 10, and the other end portion side of the first switch board 11 is arranged on the first supporting bosses 25 projecting above the second switch board 12 so as to be fixed by the screws 25*a*. As a result, the first switch board 11 is attached to the keyboard chassis 1 so as to oppose the second switch board 12 from above with a predetermined space S therebetween.

As shown in FIG. 1 and FIG. 4, the first switch 4 of the first switch board 11 includes a single contact 4*a* and is provided on the upper surface of the first switch board 11. This first switch 4 also includes a rubber sheet arranged on the first switch board 11, and a dome-shaped protruding portion is formed in this rubber sheet. The contact 4*a*, which is provided inside this dome-shaped protruding portion, includes a movable contact provided inside the protruding portion of the rubber sheet and a fixed contact provided on the first switch board 11, and is configured such that the movable contact comes into contact with the fixed contact in a manner allowing separation.

Accordingly, as shown in FIG. 7, the first switch 4 is configured such that, when the key 2 is depressed and the dome-shaped protruding portion provided on the first switch board 11 is pressed by the switch pressing section 16 of the key 2, the dome-shaped protruding portion is elastically deformed, and the movable contact of the contact 4*a* provided inside the dome-shaped protruding portion comes into contact with the fixed contact on the first switch board 11, whereby the first switch 4 is turned ON, and an ON signal is outputted.

The first switch 4 is also configured such that, in a state where the first switch 4 is turned ON by the dome-shaped protruding portion being pressed by the switch pressing section 16 of the key 2 in response to the depression of the key 2, when the key 2 returns from the final position to the initial position and the movable contact of the contact 4*a* separates from the fixed contact as shown in FIG. 1, an OFF signal is outputted by which key-OFF data instructing a sound source to silence the musical sound is acquired.

As shown in FIG. 1 and FIG. 6, the second switch 5 of the second switch board 12, which includes two contacts 5*a*, is provided on the lower surface of the second switch board 12, and protrudes below the board mounting section 10 through an opening 10*c* in the mounting section 10*b* of the board mounting section 10 of the keyboard chassis 1. In a manner similar to that of the first switch 4, the second switch 5 also includes a rubber sheet arranged on the lower surface of the second switch board 12.

A dome-shaped protruding portion is formed in this rubber sheet in a manner to project downward, and the two contacts 5*a* and 5*b* are provided inside this dome-shaped protruding portion. The two contacts 5*a* and 5*b*, which include two movable contacts provided inside the dome-shaped protruding portion and two fixed contacts provided on the lower surface of the second switch board 12, are configured such that the two movable contacts successively come into contact with the two fixed contacts in a manner allowing separation.

Accordingly, as shown in FIG. 8, the second switch 5 is configured such that, when the dome-shaped protruding portion of the rubber sheet, which is arranged on the lower surface of the second switch board 12 and protruding below the board mounting section 10, is pressed from below by the switch pressing section 22 of the hammer member 3, the protruding portion is elastically deformed, and each movable contact of the two contacts 5*a* and 5*b* provided inside the dome-shaped protruding portion successively come into contact with each fixed contact on the second switch board 12 at a different timing, whereby the second switch 5 is turned ON, and an ON signal is outputted.

That is, as shown in FIG. 1 and FIG. 6, in the configuration of the second switch 5, because the distance between the movable contact and the fixed contact configuring the contact 5*a* and the distance between the movable contact and the fixed contact configuring the contact 5*b* differ, when the protruding portion of the rubber sheet is pressed by the switch pressing section 22 of the hammer member 3 and the protruding portion becomes elastically deformed, one contact 5*a* is turned ON, and then the other contact 5*b* is turned ON. As a result, the two contacts 5*a* and 5*b* are successively operated with a time lag.

Accordingly, in the configuration of the second switch 5, as a result of the two contacts 5*a* and 5*b* being successively operated with a time lag, key-ON data and initial touch data can be acquired. The key-ON data instructs the sound source to start generating a sound, and the initial touch data, which is data related to the rotation speed of the hammer member 3, namely key-depressing speed, is used to perform the initial control of musical sound characteristics, such as the volume and tone of a musical sound.

Next, operations performed in the electronic keyboard instrument when the key 2 is depressed will be described. First, when the key 2 is pressed in FIG. 1, the key 2 rotates in the clockwise direction around the supporting shaft 14*a* of the key supporting section 14 provided on the key placing section 13 of the keyboard chassis 1. At this time, the front end portion of the key 2 moves downward while being guided by the key guiding section 6*a*, and the hammer guide section 17 of the key 2 presses downward the key contacting section 21 positioned at the front end portion of the hammer member 3.

With this movement, in the hammer member 3, the rotation supporting section 20 rotates in the clockwise direction with the hammer body 18 around the supporting shaft 9*a* of the hammer supporting section 9 provided on the lower surface of the hammer placing section 8 of the keyboard chassis 1, against the weight of the anchor section 19 of the hammer body 18. As a result, the hammer member 3 applies action load to the key 2. At this time, as shown in FIG. 7, the switch pressing section 16 of the key 2 presses the first switch 4 of the first switch board 11, so that the ON signal is outputted. In addition, the switch pressing section 22 of the hammer member 3 approaches the second switch 5 of the second switch board 12.

Then, when the key 2 is pushed further downward and the hammer member 3 rotates further in the clockwise direction, as shown in FIG. 8, the switch pressing section 22 of the hammer member 3 presses the second switch 5 of the second switch board 12, with the first switch 4 of the first switch board 11 being continuously pressed by the switch pressing section 16 of the key 2, and being turned on thereby.

At this time, the two contacts 5*a* and 5*b* of the second switch 5 are successively operated with a time lag. Accordingly, key-ON data and initial touch data are acquired. The key-ON data instructs the sound source to start generating a sound, and the initial touch data, which is data related to the rotation speed of the hammer member 3, namely the key-depressing speed, is used to perform the initial control of musical sound characteristics, such as the volume and tone of a musical sound. Based on these acquired key-ON data and initial touch data, a musical sound is generated.

As just described, when the switch pressing section 22 of the hammer member 3 presses the second switch 5 of the second switch board 12 from below to turn ON the second switch 5 with the first switch 4 of the first switch board 11 being pressed by the switch pressing section 16 of the key 2 from above as shown in FIG. 8, an impact is applied to the second switch board 12 by the hammer member 3. However, very little of the impact is transmitted to the first switch board 11.

That is, the first switch board 11 is held by the first engaging hooks 24 and the first supporting bosses 25 independently provided in the board mounting section 10 of the keyboard chassis 1, and the second switch board 12 is held at a distance below the first switch board 11 by the second engaging hooks 26 and the second supporting boss 27 independently provided in the board mounting section 10 of the keyboard chassis 1. Therefore, even when the second switch board 12 receives an impact from the hammer member 3, the impact is not easily transmitted to the first switch board 11.

In addition, even when the second switch board 12 bends upwards as a result of the switch pressing section 22 of the hammer member 3 pressing upwards the second switch 5 of the second switch board 12 while the first switch board 11 is bending downward as a result of the switch pressing section 16 of the key 2 pressing the first switch 4 of the first switch board 11 from above, the second switch board 12 does not come into contact with the first switch board 11 because the first switch board 11 is positioned above the second switch board 12 with a predetermined space S therebetween.

Accordingly, the impact applied to the second switch board 12 by the hammer member 3 is not easily transmitted to the first switch board 11. As a result, so-called chattering, in which the first switch 4 is turned OFF for an instant, does not occur even when the first switch 4 provided in the first switch board 11 is pressed by the switch pressing section 16 of the key 2 and turned ON.

Then, when returning from the final rotation positions to the initial positions, the hammer member 3 rotates in the counter-clockwise direction around the supporting shaft 9*a* of the hammer supporting section 9 supporting the rotation supporting section 20 by the weight of the anchor section 19 of the hammer body 18, and with this rotation of the hammer member 3, the key 2 rotates in the counter-clockwise direction around the supporting shaft 14*a* of the key supporting section 14. At this time, as shown in FIG. 7, first, the switch pressing section 22 of the hammer member 3 separates from the second switch 5, and the second switch 5 is turned OFF.

Then, in the case of an ordinary playing operation, as shown in FIG. 1, the hammer member 3 and the key 2 return to their initial positions. Accordingly, the switch pressing section 16 of the key 2 separates from the first switch 4, and the first switch 4 is turned OFF, whereby an OFF signal is outputted. Subsequently, the generation of the musical sound is stopped in accordance with this OFF signal from the first switch 4, so that the musical sound is silenced. In a case where an ordinary playing operation is not performed, that is, in the case of consecutive key-striking in which the same key 2 is repeatedly struck, the same key 2 is pressed again while the hammer member 3 and the key 2 are in the middle of returning to the initial positions.

At this time, as shown in FIG. 7, the same key 2 is pressed again with the switch pressing section 22 of the hammer member 3 being separated from the second switch 5 and the second switch being OFF thereby, and with the first switch 4 being pressed by the switch pressing section 16 of the key 2 and the first switch 4 being ON thereby. Accordingly, the second switch 5 is pressed by the switch pressing section 22 of the hammer member 3 and turned ON again, without the generation of the musical sound being stopped. As a result, the musical sound is consecutively generated.

In this case as well, in a state where the first switch 4 of the first switch board 11 is being pressed from above by the switch pressing section 16 of the key 2, even if an impact is applied to the second switch board 12 by the hammer member 3 when the second switch 5 of the second switch board 12 is pressed from below by the switch pressing section 22 of the hammer member 3 as shown in FIG. 8, the impact is not easily transmitted to the first switch board 11. As a result, chattering does not occur in the first switch 4.

As just described, in the electronic keyboard instrument, the first switch board 11 having the first switch 4 that is turned on by the key 2 arranged on the keyboard chassis 1 in a manner to be rotatable in the vertical direction upon the depression of the key 2, and the second switch board 12 having the second switch 2 that is turned on by the hammer member 3 that rotates to be displaced with this depression of the key 2 and applies action load to the key 2, are independently provided in the keyboard chassis 1 separated from each other. Accordingly, even if the second switch board 12 receives an impact from the hammer member 3 when the hammer member 3 turns ON the second switch 5, the first switch 4 can be prevented from being affected by the impact.

That is, in the electronic keyboard instrument, even if the second switch board 12 having the second switch 5 receives an impact from the hammer member 3 when the hammer member 3 turns ON the second switch 5 after the key 2 is pressed and the first switch 4 is turned ON thereby, the impact from the hammer member 3 is not easily transmitted to the first switch board 11 because the first switch board 11 and the second switch board 12 are independently provided separated from each other. Accordingly, chattering in which the first switch 4 is turned OFF for an instant by an impact does not occur when the hammer member 3 turns ON the second switch 5, and as a result the first switch 4 and the second switch 5 can be stably operated.

In this instance, the first switch board 11 and the second switch board 12 are arranged opposing each other from above and below with a predetermined space S therebetween in the vertical direction. Accordingly, even when the second switch board 12 bends upwards as a result of being pressed upwards by the switch pressing section 22 of the hammer member 3 while the first switch board 11 is bending downward as a result of the switch pressing section 16 of the key 2 pressing the first switch 4, the second switch board 12 does not come into contact with the first switch board 11. As a result, an impact from the hammer member 3 is not transmitted to the first switch board 11. Consequently, chattering caused by an impact from the hammer member 3 does not occur in the first switch 4, even when the first switch board 11 is bending downward as a result of the switch pressing section 16 of the key 2 pressing the first switch 4 of the first switch board 11.

In addition, the first switch board 11 is attached to the plurality of first supporting bosses 25 independently provided in the keyboard chassis 1, and one edge portion of the first switch board 11 is detachably locked by the first engaging hooks 24 provided in the keyboard chassis 1. The second switch board 12 is attached to the plurality of second supporting bosses 27 independently provided in the keyboard chassis 1 at a height lower than that of the first supporting bosses 25, and one edge portion of the second switch board 12 is detachably locked by the second engaging hooks 26 in the keyboard chassis 1 provided in a position below the first engaging hooks 24. Accordingly, the first switch board 11 and the second switch board 12 can be independently provided in the keyboard chassis 1. As a result, even when the second switch board 12 receives an impact from the hammer member 3, the impact is not easily transmitted to the first switch board 11.

Moreover, because one edge portion of the first switch board 11 is detachably locked by the first engaging hooks 24 provided in the keyboard chassis 1, vibrations in the first switch board 11 can be easily absorbed, and because one edge portion of the second switch board 12 is detachably locked by the second engaging hooks 26 provided in the keyboard chassis 1, vibrations in the second switch board 12 can be easily absorbed. In addition, the number of screw areas in the first switch board 11 and the second switch board 12 can be reduced, and one edge portion of the first switch board 11 and one edge portion of the second switch board 12 can be easily fixed to the keyboard chassis 1, whereby the assembly workability of the first switch board 11 and the second switch board 12 can be improved.

Furthermore, in the electronic keyboard instrument, the plurality of first supporting bosses 25 provided on the keyboard chassis 1 to support the first switch board 11 and the plurality of supporting bosses 27 provided on the keyboard chassis 1 at a height lower than that of the first supporting bosses 25 to support the second switch board 12 are respectively provided in positions opposing the intermediate sections of the other. As a result, a sufficient distance can be maintained between the first supporting bosses 25 and the second supporting bosses 27. Accordingly, when the second switch board 12 receives an impact from the hammer member 3, vibrations from the impact are not easily transmitted to the first switch 4, and as a result the first switch 4 and the second switch 5 can be stably operated.

In this instance, the plurality of first supporting bosses 25 and the plurality of second supporting bosses 27 are arranged at shifted positions in a front and a rear direction of the key 2. As a result, the first supporting bosses 25 and the second supporting bosses 27 are arrayed in a staggered pattern along the arrangement direction of the keys 2. Accordingly, compared to when the plurality of first supporting bosses 25 and the plurality of second supporting bosses 27 are simply provided in the intermediate sections of the other, the distance between the first supporting bosses 25 and the second supporting bosses 27 can be further increased. Consequently, when the second switch board 12 receives an impact from the hammer member 3, vibrations from the impact are more unlikely to be transmitted to the first switch 4.

Also, in the keyboard chassis 1, the plurality of first engaging hooks 24, which detachably lock one edge portion of the first switch board 11, and the plurality of second engaging hooks 26, which detachably lock one edge portion of the second switch board 12 at a position below the first engaging hooks 24, are provided at shifted positions in a front and a rear direction of the key 2, opposing the intermediate sections of the other. As a result, the first engaging hooks 24 and the second engaging hooks 26 are arrayed in a staggered pattern in the arrangement direction of the keys 2. Accordingly, a sufficient distance can be provided between the first engaging hooks 24 and the second engaging hooks 26. Consequently, when the second switch board 12 receives an impact from the hammer member 3, vibrations from the impact are not easily transmitted to the first switch 4.

Moreover, the plurality of first supporting bosses 25 and the plurality of first engaging hooks 24 are provided at shifted positions in a front and a rear direction of the key 2, opposing the intermediate sections of the other. As a result, the first supporting bosses 25 and the first engaging hooks 24 are arrayed in a staggered pattern along the arrangement direction of the keys 2. Accordingly, the strength of attachment of the first switch board 11 can be efficiently ensured by the plurality of first supporting bosses 25 and the plurality of first engaging hooks 24. Also, the plurality of second supporting bosses 27 and the plurality of second engaging hooks 26 are provided at shifted positions in a front and a rear direction of the key 2, opposing the intermediate sections of the other. As a result, the second supporting bosses 27 and the second engaging hooks 26 are arrayed in a staggered pattern along the arrangement direction of the keys 2. Accordingly, the strength of attachment of the second switch board 12 can be efficiently ensured by the plurality of second supporting bosses 27 and the plurality of second engaging hooks 26.

In the electronic keyboard instrument, the first switch 4 includes the single contact 4*a*, and the second switch 5 includes the two contacts 5*a* and 5*b* that are successively turned ON at different timings. Accordingly, when the second switch 5 is turned ON by the hammer member 3 after the key 2 is depressed and the first switch 4 is turned ON thereby, the two contacts 5*a* and 5*b* of the second switch 5 are successively turned ON with a time lag at different timings. As a result, Key-ON data, which instructs the sound source to start generating a sound, and initial touch data, which is used to perform initial control of musical sound characteristics such as volume and tone of a musical sound based on the rotation speed of the hammer member 3, are acquired and consequently a musical sound can be successfully generated.

In this instance, silence data for stopping the generation of the musical sound can be acquired by the contact 4*a* of the first switch 4 being turned OFF when the key 2 returns to its initial position after being depressed. Accordingly, in an ordinary playing operation, the musical sound can be silenced by the first switch 4. In the case of consecutive key-striking in which the same key 2 is repeatedly struck is performed, when the same key 2 is depressed again with the musical sound being generated by the switch pressing section 16 of the key 2 turning on the first switch 4 after the second switch is turned OFF by the switch pressing section 22 of the hammer member 3 being separated from the second switch 5, the second switch 5 is turned ON by being pressed again by the switch pressing section 22 of the hammer member 3 without the generation of the musical sound being stopped, whereby the musical sound is consecutively generated.

Second Embodiment

Next, the present invention will hereinafter be described with reference to a second embodiment shown in FIG. 9 to FIG. 11 in which the present invention has been applied to an electronic keyboard instrument. Note that sections that are the same as those of the first embodiment in FIG. 1 to FIG. 8 are given the same reference numbers.

Figure 9:
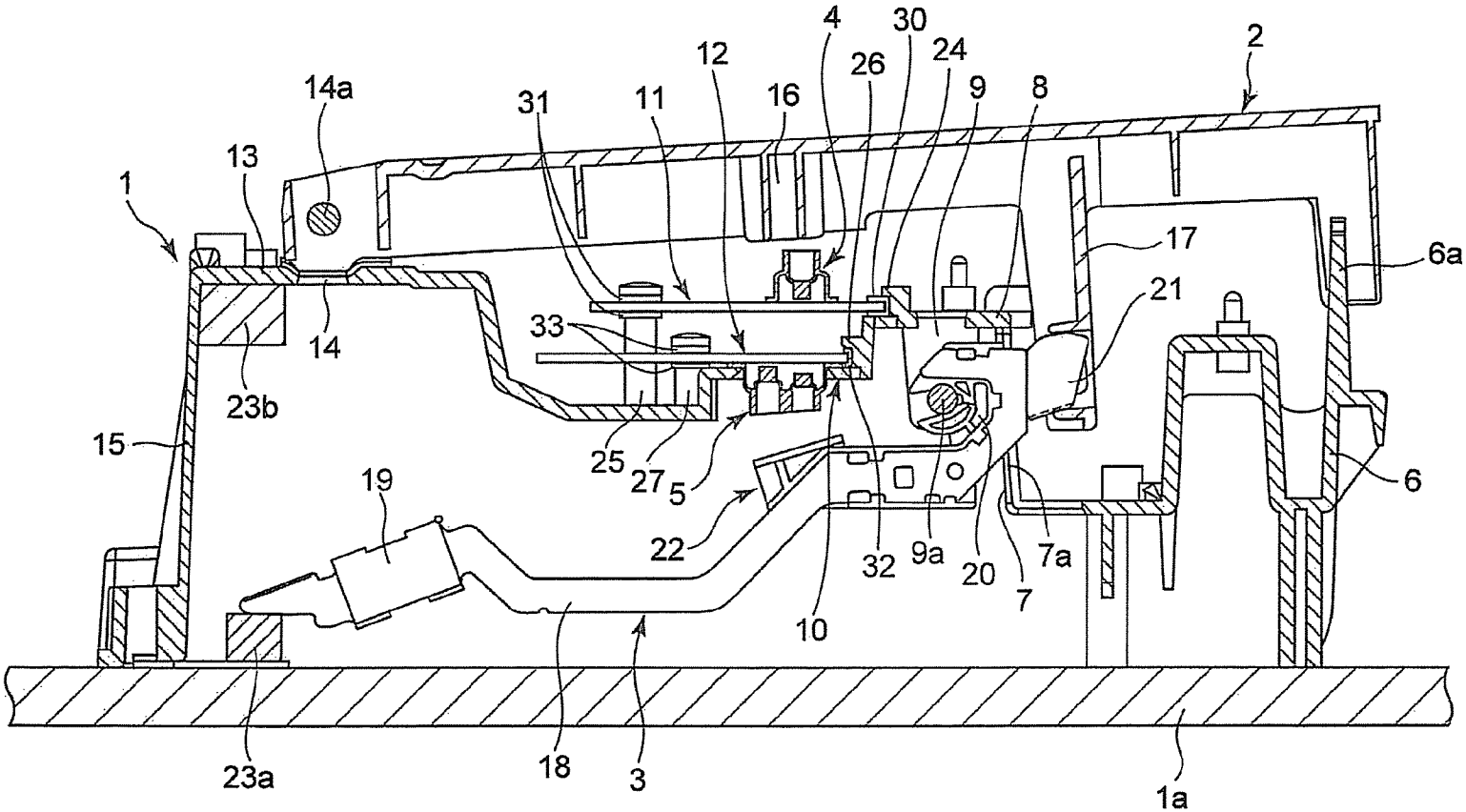
FIG. 9 is a cross-sectional view showing the main section of a second embodiment where the present invention has been applied to a electronic keyboard instrument.

As shown in FIG. 9, in this electronic keyboard instrument, an attachment structure for attaching the first switch board 11 and the second switch board 12 to the keyboard chassis 1 is configured differently from that of the first embodiment. However, anything other than this is configured the same as that of the first embodiment.

In this instance as well, the plurality of first engaging hooks 24 for detachably locking one edge portion (right edge portion in FIG. 9) of the first switch board 11 is provided in the upper portion of the side wall section 10*a* of the board mounting section 10 of the keyboard chassis 1. In addition, the plurality of first supporting bosses 25 for attaching the other edge portion side (left edge portion side in FIG. 9) of the first switch board 11 by the screws 25*a* is provided on the board mounting section 10 of the keyboard chassis 1.

Figure 10:
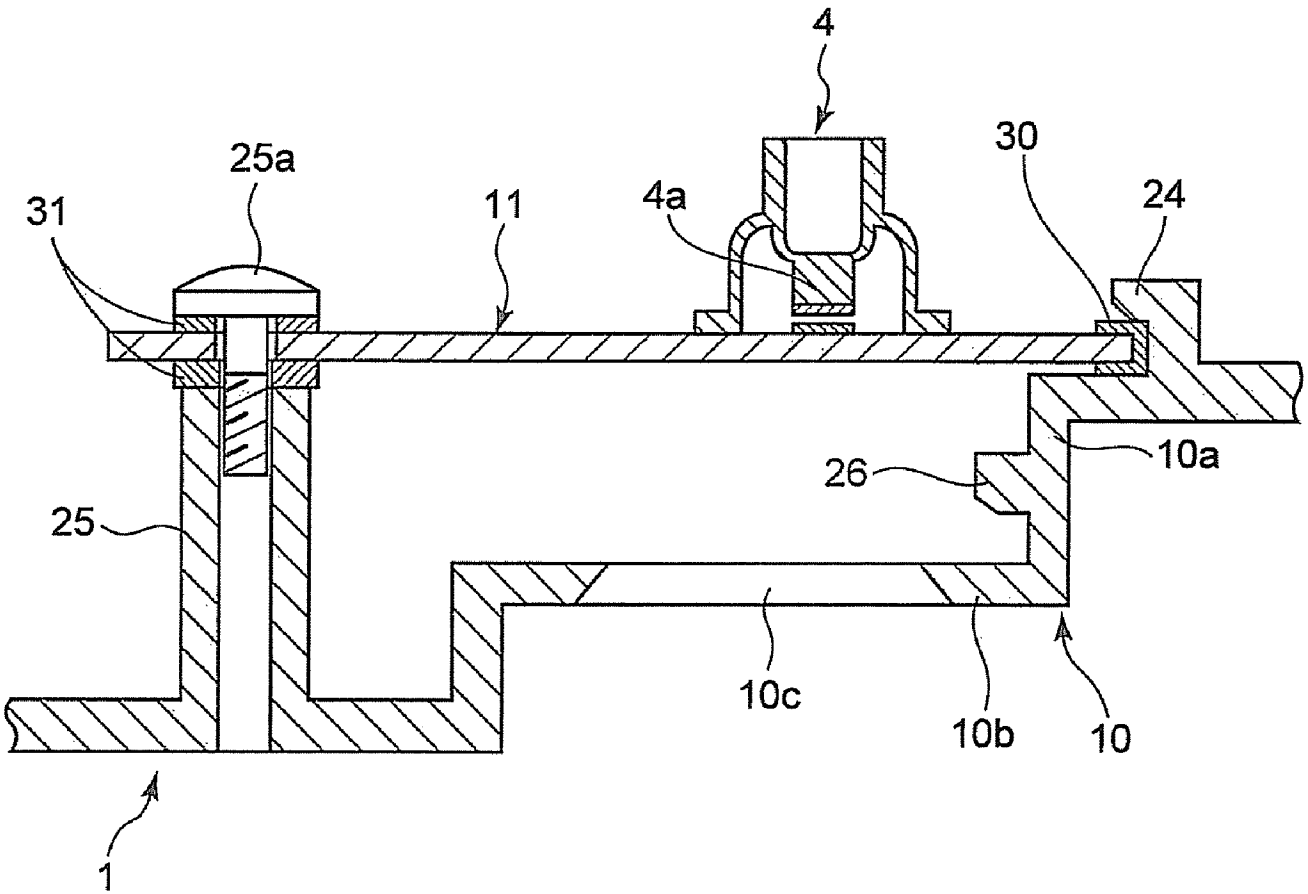
FIG. 10 is an enlarged cross-sectional view of the main section, showing a supporting structure for a first switchboard in the electronic keyboard instrument in FIG. 9.

As shown in FIG. 10, one edge portion (right edge portion in FIG. 10) of the first switch board 11 is locked by the first engaging hooks 24 with a first shock absorbing member 30 such as rubber therebetween. In addition, the other edge portion side of the first switch board 11 is attached to the first supporting bosses 25 by the screws 25*a* with a second shock absorbing member 31 such as rubber therebetween. In this instance, the first shock absorbing member 30 is formed to have a U-shaped cross-section so as to cover one edge portion of the first switch board 11 in areas corresponding to the first engaging hooks 24. In addition, the second shock absorbing member 31 is disposed on both upper and lower surfaces of the first switch board 11 in areas corresponding to the first supporting bosses 25.

Similarly, the plurality of second engaging hooks 26 for detachably locking one edge portion (right edge portion in FIG. 9) of the second switch board 12 is provided in the lower portion of the side wall section 10*a* of the board mounting section 10 of the keyboard chassis 1. In addition, the plurality of second supporting bosses 27 for attaching the other edge portion side (left edge portion side in FIG. 9) of the second switch board 12 by the screws 27*a* is provided on the board mounting section 10 of the keyboard chassis 1.

Figure 11:
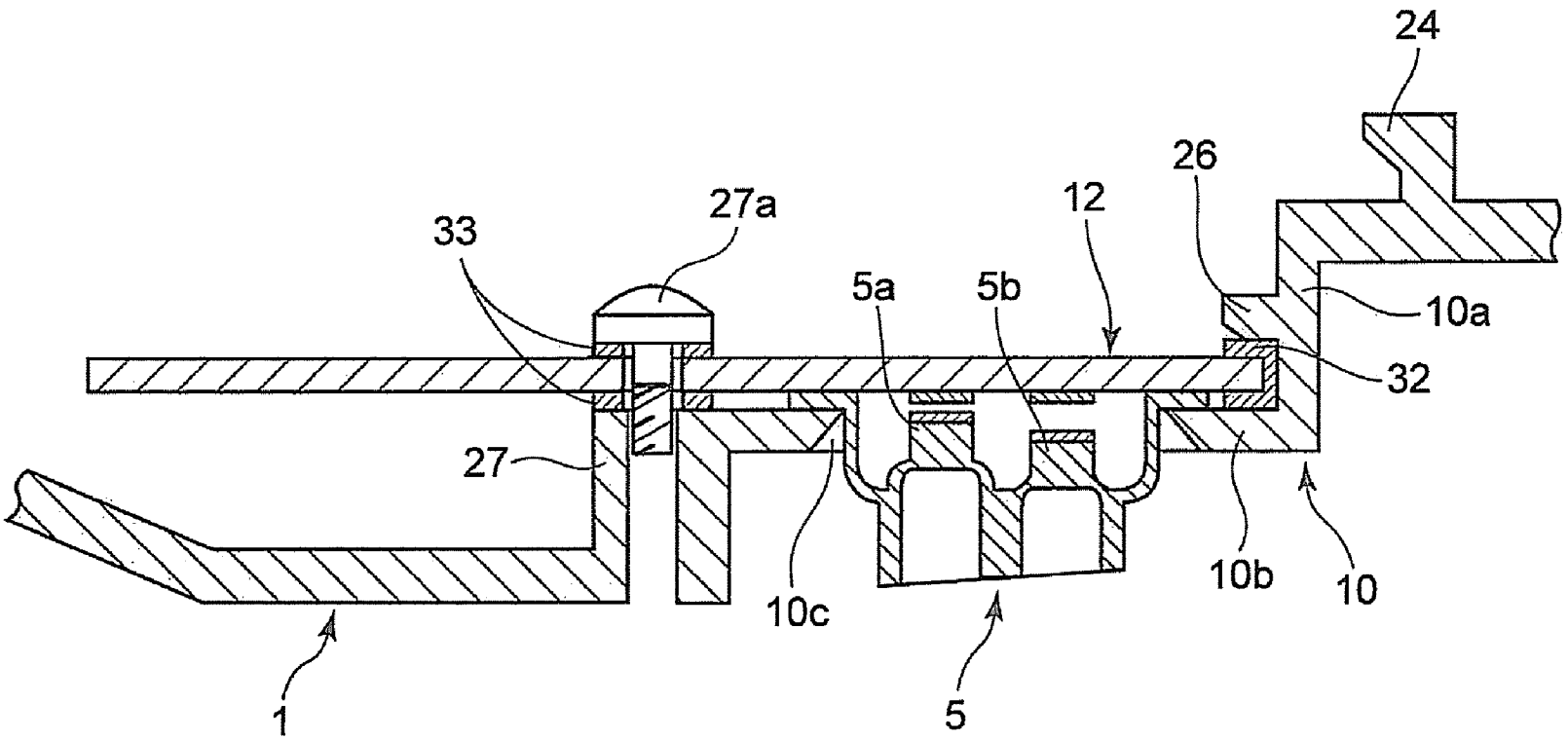
FIG. 11 is an enlarged cross-sectional view of the main section, showing a supporting structure for a second switch board in the electronic keyboard instrument in FIG. 10.

Also, as shown in FIG. 11, one edge portion (right edge portion in FIG. 11) of the second switch board 12 is locked by the second engaging hooks 26 with a third shock absorbing member 32 such as rubber therebetween. In addition, the other edge portion side of the second switch board 12 is attached to the second supporting bosses 27 by the screws 27*a* with a fourth shock absorbing member 33 such as rubber therebetween. In this instance as well, the third shock absorbing member 32 is formed to have a U-shaped cross-section so as to cover one edge portion of the second switch board 12 in areas corresponding to the second engaging hooks 26. In addition, the fourth shock absorbing member 33 is arranged on both upper and lower surfaces of the second switch board 12 in areas corresponding to the second supporting bosses 27.

In an electronic keyboard instrument such as that described above, effects similar to those achieved by the first embodiment can be achieved. In addition, the first switch board 11 is locked by the first engaging hooks 24 with the first shock absorbing member 30 therebetween and is screwed onto the first supporting bosses 25 with the second shock absorbing member 31 therebetween. The second switch board 12 is locked by the second engaging hooks 26 with the third shock absorbing member 32 therebetween and is screwed onto the second supporting bosses 25 with the fourth shock absorbing member 33 therebetween. Accordingly, when the second switch board 12 receives an impact from the hammer member 3, this impact on the second switch board 12 can be reduced by the third shock absorbing member 32 and the fourth shock absorbing member 33. In addition, the transmission of the impact received by the second switch board 12 to the first switch board 11 can be further reduced by the first shock absorbing member 30 and the second shock absorbing member 31.

While the present invention has been described with reference to the preferred embodiments, it is intended that the invention be not limited by any of the details of the description therein but includes all the embodiments which fall within the scope of the appended claims.

What is claimed is:

1. An electronic keyboard instrument in which a key is arranged on a keyboard chassis in a manner to be rotatable in a vertical direction, and a hammer member correspondingly arranged below the key rotates to be displaced in response to a depression of the key and applies an action load to the key, comprising:

a first switch board having a first switch that is turned ON by the key upon a depression of the key; and a second switch board having a second switch that is turned ON by the hammer member that rotates to be displaced in response to the depression of the key;

wherein the first switch board and the second switch board are independently provided in the keyboard chassis separated from each other.

2. The electronic keyboard instrument according to claim 1, wherein the first switch board and the second switch board are arranged opposing each other from above and below with a predetermined space therebetween in a vertical direction.

3. The electronic keyboard instrument according to claim 1, wherein the first switch board is attached to a plurality of first supporting sections independently provided in the keyboard chassis, and the second switch board is attached to a plurality of second supporting sections independently provided in the keyboard chassis at a height lower than that of the first supporting sections.

4. The electronic keyboard instrument according to claim 3, wherein one edge portion of the first switch board is detachably locked by a first engaging section that is provided in the keyboard chassis, and one edge portion of the second switch board is detachably locked by a second engaging section that is provided in the keyboard chassis and positioned below the first engaging section.

5. The electronic keyboard instrument according to claim 1, wherein the first switch includes a single contact, and the second switch includes two contacts that are successively turned ON at different timings.

6. The electronic keyboard instrument according to claim 3, wherein the plurality of first supporting sections and the plurality of second supporting sections are respectively provided in positions opposing intermediate sections of the other.

7. The electronic keyboard instrument according to claim 6, wherein the plurality of first supporting sections and the plurality of second supporting sections are provided at shifted positions in a front and a rear direction of the key and accordingly arranged in a staggered pattern along an arrangement direction of the keys.

8. The electronic keyboard instrument according to claim 1, wherein the keyboard chassis includes a plurality of first engaging sections that detachably lock one edge portion of the first switch board, and a plurality of second engaging sections that detachably lock one edge portion of the second switch board at a position below the plurality of first engaging sections.

9. The electronic keyboard instrument according to claim 8, wherein the plurality of first engaging sections and the plurality of second engaging sections are provided opposing intermediate sections of the other at shifted positions in a front and a rear direction of the key and accordingly arranged in a staggered pattern along an arrangement direction of the keys.

10. The electronic keyboard instrument according to claim 8, wherein the plurality of first supporting sections and the plurality of first engaging sections are provided opposing intermediate sections of the other at shifted positions in a front and a rear direction of the key and accordingly arranged in a staggered pattern along an arrangement direction of the keys, and the plurality of second supporting sections and the plurality of second engaging sections are provided opposing intermediate sections of the other at shifted positions in a front and a rear direction of the key and accordingly arranged in a staggered pattern along an arrangement direction of the keys.

* * * * *